US005323750A

United States Patent [19]

Rotter

[11] Patent Number: 5,323,750

[45] Date of Patent: Jun. 28, 1994

[54] INTEGRAL ENGINE VALVE COVER AND FUEL PUMP

[75] Inventor: Terrence M. Rotter, Sheboygan Falls, Wis.

[73] Assignee: Kohler Co., Kohler, Wis.

[21] Appl. No.: 111,798

[22] Filed: Aug. 25, 1993

[51] Int. Cl.[5] ..... F02M 37/04

[52] U.S. Cl. ..... 123/508; 123/509

[58] Field of Search ..... 123/508, 509, 507, 495, 123/90.38, 198 C; 417/412, 413, 380, 381

[56] References Cited

U.S. PATENT DOCUMENTS

| | | | |
|---|---|---|---|
| 1,963,658 | 6/1934 | Ford | 123/509 |
| 2,104,448 | 1/1938 | Babitch et al. | 123/139 |
| 2,449,468 | 9/1948 | Greenland | 123/508 |
| 2,796,057 | 6/1957 | Dolza | 123/509 |
| 2,955,582 | 10/1960 | Taylor | 123/119 |
| 3,094,976 | 6/1963 | May | 123/119 |
| 3,901,204 | 8/1975 | Jaulmes | 123/495 |
| 4,391,258 | 7/1983 | Claesson | 123/508 |
| 4,567,872 | 2/1986 | Roosa | 123/508 |
| 5,161,496 | 11/1992 | Matsushima | 123/508 |

FOREIGN PATENT DOCUMENTS

| | | | |
|---|---|---|---|
| 3643071 | 6/1988 | Fed. Rep. of Germany | 123/507 |
| 8101593 | 6/1981 | PCT Int'l Appl. | 123/508 |

*Primary Examiner*—Carl S. Miller

*Attorney, Agent, or Firm*—Quarles & Brady

[57] ABSTRACT

A fuel pump body has a chamber with one wall formed by an external diaphragm having a stem connected thereto. The fuel pump body is attached to the outside of a valve cover for a gasoline engine and the valve cover has a depression that forms an enclosure for the diaphragm. The stem passes through an aperture in the valve cover and connects to a lever pivotally attached to the underside of the valve cover. The lever engages the valve rocker arm of the engine and produces reciprocal movement of the stem and diaphragm as the rocker arm moves. The reciprocal movement of the diaphragm alternately draws fuel into the chamber through the inlet and that expels fuel through the outlet.

9 Claims, 2 Drawing Sheets

INTEGRAL ENGINE VALVE COVER AND FUEL PUMP

BACKGROUND OF THE INVENTION

The field of the present invention is gasoline engines, and in particular fuel pumps for such engines.

In many small gasoline engines, such as those used to power lawn and garden equipment and electrical generators, the fuel tank is mounted above the carburetor. This allows the fuel to flow by gravity from the tank to the carburetor without the need for a pump. The fuel tank can even be mounted a small distance below the carburetor with the fuel being drawn into the carburetor by a vacuum created in the carburetor by the Bernoulli effect.

However, in some applications, the fuel tank must be located a significant distance below the carburetor where the vacuum created in the fuel line at the carburetor is inadequate to overcome the force of gravity. Since this type of gasoline engine was designed to operate without a fuel pump, provision was not made to attach a mechanical fuel pump to the engine for these applications. Such a mechanical fuel pump requires access through the engine block for a pump lever to engage the cam shaft or the crank shaft. Furthermore, since these relatively small engines do not have an electric generator, it is impractical to provide an electric fuel pump for such applications.

As a consequence, engines that were designed to function without a fuel pump heretofore could not be utilized readily with a gas tank mounted a significant distance below the carburetor.

SUMMARY OF THE INVENTION

An object of the invention is to provide a fuel pump which can be retrofitted to a conventional small gasoline engine so that the fuel tank can be mounted a significant distance from the carburetor.

This objective is achieved by integrating a fuel pump into a valve cover of the engine and providing a pump actuator that is mechanically driven by the mechanism, such as a rocker arm, which operates an engine valve.

The preferred embodiment of the fuel pump has a body that forms a chamber with an opening through a wall of the body. An inlet and an outlet are provided for the chamber and check valves restrict flow to only one direction through the inlet and outlet. A flexible diaphragm extends across the opening of the body. A valve cover for the gasoline engine is attached to the body to form at least part of an enclosure for the diaphragm. An actuating member is coupled to the diaphragm and is operated by the device that operates the cylinder valve, to produce movement of the diaphragm.

Therefore, in situations where the gas tank is mounted significantly below the carburetor, the standard valve cover can be replaced with the integral pump and cover assembly. This enables a standard engine to be adapted for such use without a major retrofit or a redesign of the engine.

DETAILED DESCRIPTION OF THE INVENTION

Figure 1:
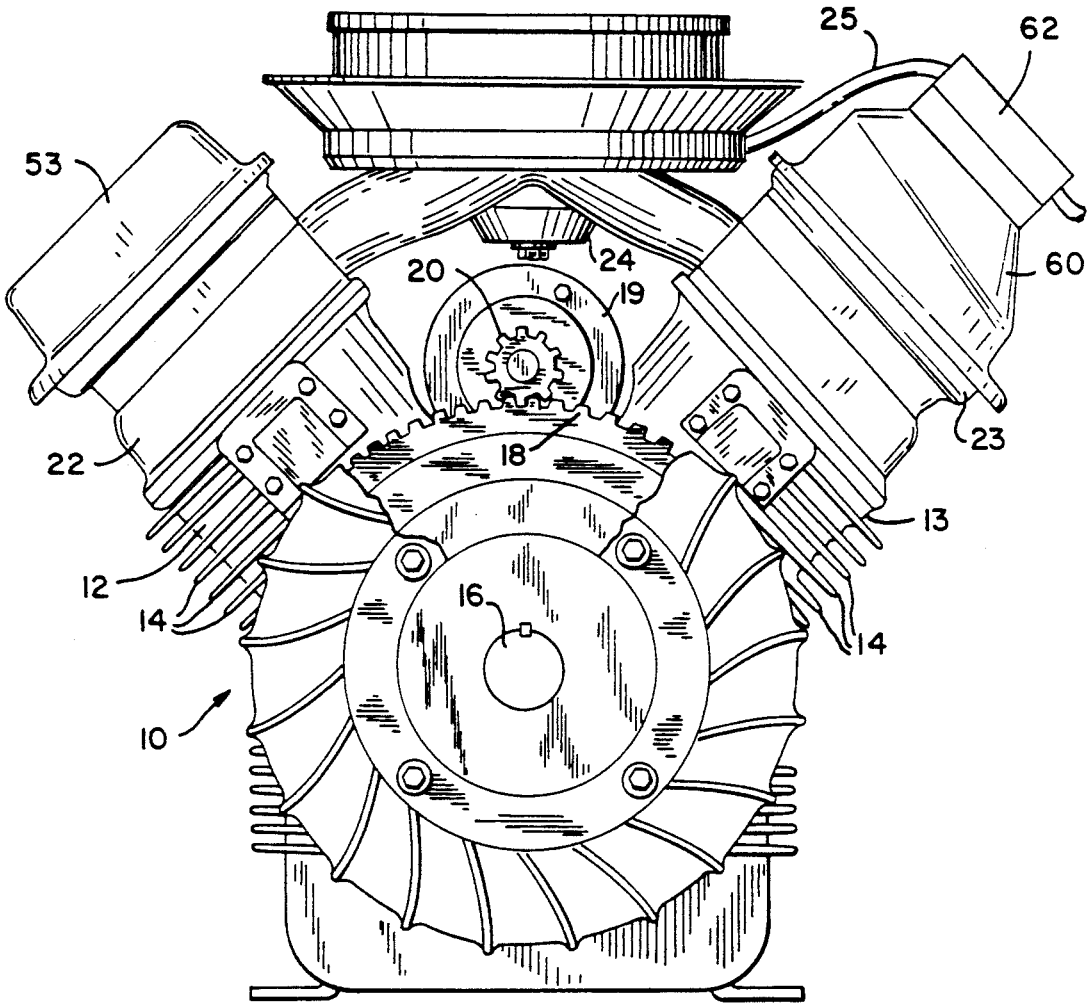
FIG. 1 is a side elevation view illustrating a gasoline engine which incorporates the present invention.

Referring to FIG. 1, an engine generally designated as 10 is composed of two cylinders 12 and 13 with cooling fins 14. There is the usual crankshaft 16 connected to a ring gear 18 which is engaged by a starter gear 20 of starter 19. At the top of each cylinder 12 and 13 is a cylinder head 22 and 23, respectively. Each cylinder head 22 and 23 has a conventional fuel mixture passage extending from a carburetor 24 with a cylinder inlet valve sealing the passage during appropriate portions of the combustion cycle. An exhaust passage is also provided in each of the cylinder heads 22 and 23 which also is sealed by an outlet valve.

Figure 2:
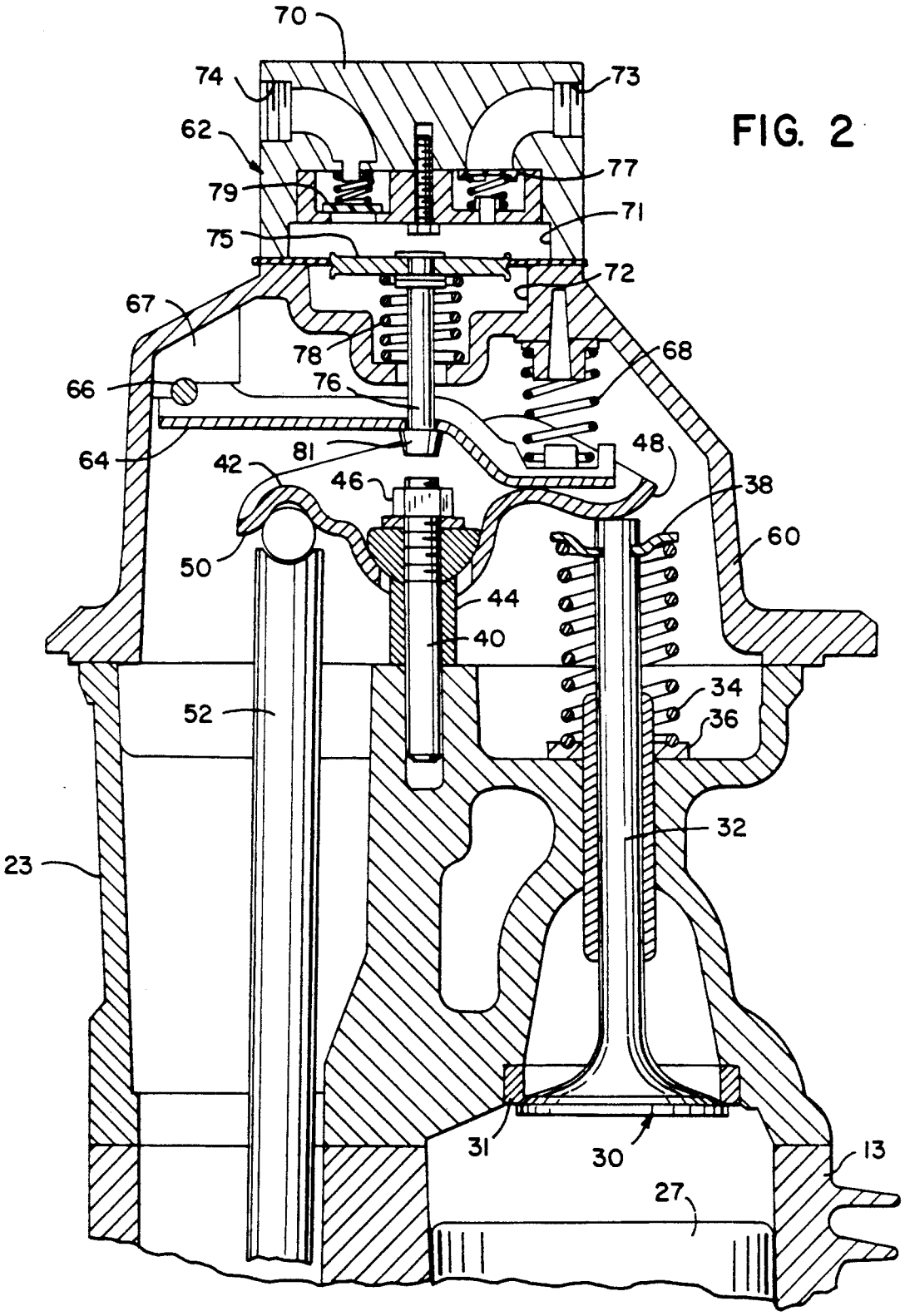
FIG. 2 is a cross sectional view taken through the fuel pump and cylinder head assembly in FIG. 1.

FIG. 2 is a cross-section through cylinder head 23 showing the valve operating mechanism and piston 27 in cylinder 13. One of the cylinder valves 30 has a shaft 32 extending upwardly through a hole in the cylinder head 23. The cylinder valve 30 may be either an exhaust valve or an inlet valve for the engine cylinder 13. The cylinder valve 30 is biased against a seat 31 in the cylinder head by valve spring 34 positioned on a support 36 and against a retainer 38 attached to the end of the valve stem 32 in a conventional manner.

A post 40 is press fit into the upper surface of cylinder head 22. A rocker arm 42 has a central aperture through which the post 40 extends and is held onto the post by a pivot sleeve 44 and nut 46 attached to a threaded end of the post. One end 48 of the rocker arm 42 engages the end of the valve stem 32. The opposite end 50 of rocker arm 42 is engaged by one end of a push rod 52. The push rod 52 extends downward through another hole in the cylinder head 22 and engages a cam shaft (not shown) within the engine. A cam on the cam shaft causes the push rod 52 t rise and fall at different times during the combustion cycle. As the push rod 52 rises, the rocker arm 42 pivots about sleeve 44, pushing the valve stem 32 downward and opening the cylinder valve 30 in a conventional manner. This type of push rod rocker arm and valve mechanism is conventional for internal combustion engines.

Typically, the rocker arm assembly is enclosed by a cover 53 (FIG. 1) that extends over those components and is fastened to the cylinder head 22 by bolts (not visible). Such a valve cover 53 is used on the other cylinder head 23 when a fuel pump is not required on engine 10.

However, when placement of the gasoline tank requires the use of a fuel pump in order to draw fuel into the carburetor, the conventional valve cover 53 on cylinder head 23 is replaced by a valve cover 60 having an integral fuel pump 62, as shown in FIG. 2. The valve cover 60 is made of thermoset plastic which acts as an insulator to prevent overheating of the fuel flowing through the pump 62. An actuating lever 64 which pivots about a bolt 66 attached to an inside surface 67 of the valve cover 60 that is adjacent to the push rod 52. The actuating lever 64 extends across the width of the valve cover, resting against the upper surface of rocker arm 42 adjacent to the point of contact with the valve stem 32. A return spring 68 extends between the actuating lever 64 and an upper portion of the valve cover 60 and biases the actuating lever 64 against the valve rocker arm 42.

The valve cover 60 has a inward depression 72 over which the fuel pump 62 is mounted on the outside of the cover. The fuel pump has a body 70 that forms a chamber 71 at an opening in the wall of the body that faces the valve cover 60. A fuel inlet 73 and outlet 74 are provided for the chamber 71. An inlet check valve 77 is located at the chamber opening of the inlet 73 and is biased to permit fuel to flow only from the inlet into the chamber. A similar outlet check valve 79 is located at the chamber opening of the outlet 74 and is biased to permit fuel to flow only from the chamber into the outlet.

A flexible diaphragm 75 of the fuel pump 62 extends across the opening of the chamber 71 in the wall of the body 70 and serves a wall of the chamber. The portion of the valve cover 60 containing depression 72 acts as an enclosure for one side of the diaphragm 75 with the diaphragm moving into the depression during the pumping cycle. A stem 76 is centrally attached to the diaphragm 75 projecting downward into the depression 72 and through an aperture at the bottom of that depression. A diaphragm spring 78 extends around the stem 76, abutting the diaphragm 75 and the bottom of the depression 72. Spring 78 biases the diaphragm 75 away from the depression 72 toward fuel pump body 70 and controls the fuel pressure supplied to the carburetor. The end of the stem 76 which is remote from the diaphragm 75 passes through an aperture in the actuating lever 64 and has a knob 81 at that end. The force of the lever return spring 68 must be greater than the force of the diaphragm spring 78 so that the lever follows the movement of the rocker arm 42.

As end 48 of the rocker arm 64 moves up and down, so does the actuating lever 64, pivoting about bolt 66. The return spring 68 forces the actuating lever 64 against the rocker arm 42. When the actuating lever 64 moves downward, in the orientation shown in FIG. 2, it acts on knob 81 pulling the stem 76 downward which exerts a downward force on the diaphragm 75, which expands the chamber 71 of the fuel pump 62. This action creates a negative pressure within the chamber 71 drawing fuel through the inlet valve 72 from the fuel tank into the chamber. When the cylinder valve 30 closes, the actuating lever 64 moves upward producing an upward movement of stem 76 and diaphragm 75 due to the force of the diaphragm spring 78. This action returns the diaphragm 75 to the illustrated position and reduces the volume of pump chamber 71. As this occurs, the fuel previously drawn into the pump chamber 71 is forced out through the outlet valve 74 and through supply tube 25 to the carburetor 24. Each time the cylinder valve 30 opens and closes, this pumping action is repeated.

The present fuel pump 62 on the valve cover 60 is mounted closer to the carburetor 24 than conventional pumps that are mounted on the side of the engine block. This feature results in a shorter fuel line. The integration of the fuel pump body with the valve cover reduces the number of components of the pump by using a portion of the valve cover as part of the pump enclosure. The present pump also is more accessible for servicing since valve covers typically are located at the top of an engine compartment.

Alternatively the pump 62 could be mounted on a side of the valve cover and attached to an L-shaped lever 64 which exerts reciprocal horizontal forces on the diaphragm stem 76. Although the present invention has been described in the context of an engine having the cam shaft below the cylinder heads, the present fuel pump design can be utilized with an over-head cam shaft in which the pump is activated by either the rocker arm or directly by the cam shaft. In addition this fuel pump assembly can be used on single cylinder engines or those having more than two cylinders.

I claim:

1. A fuel pump assembly for a gasoline engine which has a mechanism that operates a cylinder valve, said fuel pump assembly comprising:

a body having a chamber, and an inlet and an outlet in communication with the chamber;

a first check valve connected to the inlet;

a second check valve connected to the outlet;

a flexible diaphragm extending across the chamber of said body;

a valve cover for enclosing the cylinder valve of the gasoline engine and being attached to said body to form at least part of an enclosure for the diaphragm; and an actuating member coupled to said diaphragm and operable, by the mechanism that operates a cylinder valve, to produce movement of the diaphragm.

2. The fuel pump assembly as recited in claim 1 wherein said actuating member comprises a stem attached to the diaphragm and extending through an aperture in said valve cover.

3. The fuel pump assembly as recited in claim 2 further comprising a spring around said stem between said diaphragm and said valve cover.

4. The fuel pump assembly as recited in claim 2 further comprising a lever pivotally attached to said valve cover and coupled to said stem for engaging the mechanism that operates the cylinder valve.

5. The fuel pump assembly as recited in claim 4 further comprising a return spring biasing said lever against the mechanism that operates the cylinder valve.

6. The fuel pump assembly as recited in claim 4 wherein the mechanism that operates the cylinder valve includes a rocker arm, and said lever comprises a portion for making contact with that rocker arm.

7. A fuel pump assembly for a gasoline engine which has a cylinder valve operating mechanism, said assembly comprising:

a body having a chamber with an opening through a wall of said body, and an inlet and an outlet communicating with the chamber;

a first check valve connected to the inlet and allowing fuel to flow only into the chamber;

a second check valve connected to the outlet and allowing fuel to flow only from the chamber;

a flexible diaphragm extending across the opening in said body and forming a wall of the chamber;

a valve cover for enclosing cylinder valves of the gasoline engine and having a depression, said valve cover being attached to said body so that the depression forms at least part of an enclosure for the diaphragm;

a stem connected to said diaphragm and extending though an aperture in said valve cover; and a lever pivotally attached to said valve cover for engaging cylinder valve operating mechanism and being coupled to said stem so that movement of said lever results in movement of said diaphragm which draws fuel into the chamber through the inlet and then expels fuel from the chamber through the outlet.

8. A gasoline engine comprising:

an engine body having a cylinder with a first aperture;

a piston within the cylinder;

a valve for selectively opening and closing the first aperture;

a mechanism attached to said engine body for operating said valve in response to movement of said piston;

a valve cover extending about said cylinder valve and having a second aperture; and a fuel pump having a diaphragm and a stem connected to the diaphragm and coupled to said mechanism, said fuel pump being attached to said valve cover with the stem extending through the second aperture, said valve cover forming at least part of an enclosure for the diaphragm.

9. The fuel pump assembly as recited in claim 8 further comprising a lever pivotally coupled to said valve cover and engaging said mechanism and said stem so that movement of said mechanism causes movement of said diaphragm.

* * * * *